US005218940A

United States Patent [19]

Rodriguez et al.

[11] Patent Number: 5,218,940

[45] Date of Patent: Jun. 15, 1993

[54] ANEROID BOOST MODULATOR

[75] Inventors: Jose A. Rodriguez, Chicago; Rimas L. Petrosius, Riverside; Thomas B. Lisak, Algonquin; George E. Nicoletti, North Riverside; Michael P. Lasecki, Villa Park, all of Ill.

[73] Assignee: Navistar International Transportation Corp., Chicago, Ill.

[21] Appl. No.: 902,464

[22] Filed: Jun. 19, 1992

Related U.S. Application Data

[63] Continuation of Ser. No. 673,430, Mar. 22, 1991, abandoned.

[51] Int. Cl.[5] ..... F02D 7/00

[52] U.S. Cl. ..... 123/383; 123/382

[58] Field of Search ..... 123/382, 383, 370, 372, 123/365

[56] References Cited

U.S. PATENT DOCUMENTS

| | | | |
|---|---|---|---|
| 2,008,143 | 7/1935 | Mock | 123/383 |
| 2,749,898 | 6/1956 | Isley | 123/383 |
| 3,435,813 | 4/1969 | Wagner | 123/383 |
| 4,068,642 | 1/1978 | Little | 123/382 |
| 4,095,572 | 6/1978 | Scholtz | 123/383 |
| 4,159,753 | 7/1979 | Boche | 123/382 |
| 4,248,188 | 2/1981 | Wilson | 123/382 |
| 4,286,559 | 9/1981 | Ritter et al. | 123/383 |
| 4,372,268 | 2/1983 | Kolarik | 123/383 |
| 4,380,223 | 4/1983 | Jefferson | 123/383 |
| 4,441,472 | 4/1984 | Knorreck | 123/383 |
| 4,581,723 | 6/1971 | Scholl | 123/382 |
| 4,727,839 | 3/1988 | Bruhmann et al. | 123/383 |

*Primary Examiner*—Carl S. Miller

*Attorney, Agent, or Firm*—Dennis K. Sullivan

[57] ABSTRACT

An aneroid boost modulator briefly restricts mass air flow from a turbocharged diesel engine intake manifold to a fuel injection pump aneroid control during free engine acceleration to inhibit operation of the aneroid controller until the engine and the turbocharger develop sufficient speed to use the increasing fuel supply efficiently. The modulator eliminates emission of black smoke from the engine during free engine acceleration while having no significant affect on acceleration of the engine under a load as in accelerating a vehicle.

8 Claims, 1 Drawing Sheet

ANEROID BOOST MODULATOR

This is a continuation of application Ser. No. 07/673,430, filed Mar. 22, 1991, now abandoned.

BACKGROUND OF THE INVENTION

The present invention relates to a system for limiting the smoke produced by a diesel engine during free or snap engine acceleration, that is, acceleration with the engine uncoupled or free from the vehicle drive line, without adversely affecting engine performance. More particularly, the modulator, which is located between the engine intake manifold boost pressure outlet and the fuel injection pump aneroid control, comprises a carefully tuned orifice and an accumulator defining a preselected volume for modulating the action of the injection pump aneroid to maintain fuel being supplied to the injection pump in full cutback during brief periods of free engine acceleration while allowing relatively normal operation of the aneroid control when accelerating a vehicle to maintain driveability.

THE PRIOR ART

The elimination of visible smoke emitted by a turbocharged diesel engine upon acceleration under various load conditions is a significant problem with respect to air pollution standards. Significant reduction of the smoke has been achieved over the years by aneroid controllers which control the amount of fuel delivered to a diesel engine injection system depending on the intake manifold or boost pressure.

During acceleration of a turbocharged engine, the aneroid controller limits the movement of the rack in the injection pump, which controls the amount of fuel delivered to the engine combustion chambers, from going to the maximum fuel delivery position under the influence of the injection pump governor unless there is sufficient air available, as measured by the intake manifold pressure, to attain complete combustion. Knorreck U.S. Pat. No. 4,441,472, Ritter et al. U.S. Pat. No. 4,286,559, and Brühmann et al. U.S. Pat. No. 4,727,839 disclose various aneroid controllers comprising pneumatic diaphragm control devices for fuel injection apparatus which include thrust rod elements which are actuable by a pressure regulated diaphragm to regulate the position of the rack and thus the amount of fuel being provided to the injectors. These devices are typical aneroid controllers with which the modulator of the present invention may be usefully employed.

SUMMARY OF THE INVENTION

It is a primary object of the present invention to provide a simple structure for controlling the operation of the aneroid to further control the aneroid diaphragm movement and therefore the amount of fuel being provided to the engine during brief periods of free engine acceleration to significantly limit the amount of smoke produced during such acceleration while allowing normal aneroid operation to maintain vehicle driveability during normal vehicle acceleration.

It is a further object of the invention to provide an aneroid boost modulator to briefly but severely restrict air flow to an aneroid control of a turbocharged diesel engine from an intake manifold outlet of the engine during free engine acceleration.

These objects are specifically met in a modulator apparatus for use in combination with an aneroid control for a diesel fuel injection pump wherein the aneroid has a variable volume chamber which expands under the influence of the pressure in the engine intake manifold to increase the maximum fuel quantity which may be delivered to the engine by the injection pump, the modulator being a chamber of relatively large volume, compared to the variable volume chamber of the aneroid, positioned between the aneroid and the intake manifold outlet and an orifice positioned between the intake manifold and the large volume chamber. The orifice creates a severe restriction in the flow of air to the enlarged volume chamber and to the variable volume chamber of the aneroid and thus, when properly sized relative to the volume of the two chambers, delays the operation of the aneroid for a period longer than the brief period required for free engine acceleration to take place.

BRIEF DESCRIPTION OF THE DRAWINGS

Other objects and advantages of the invention will become more apparent upon a perusal of the detailed description thereof and upon reference to the drawings, in which.

DESCRIPTION OF THE PREFERRED EMBODIMENT

Figure 1:
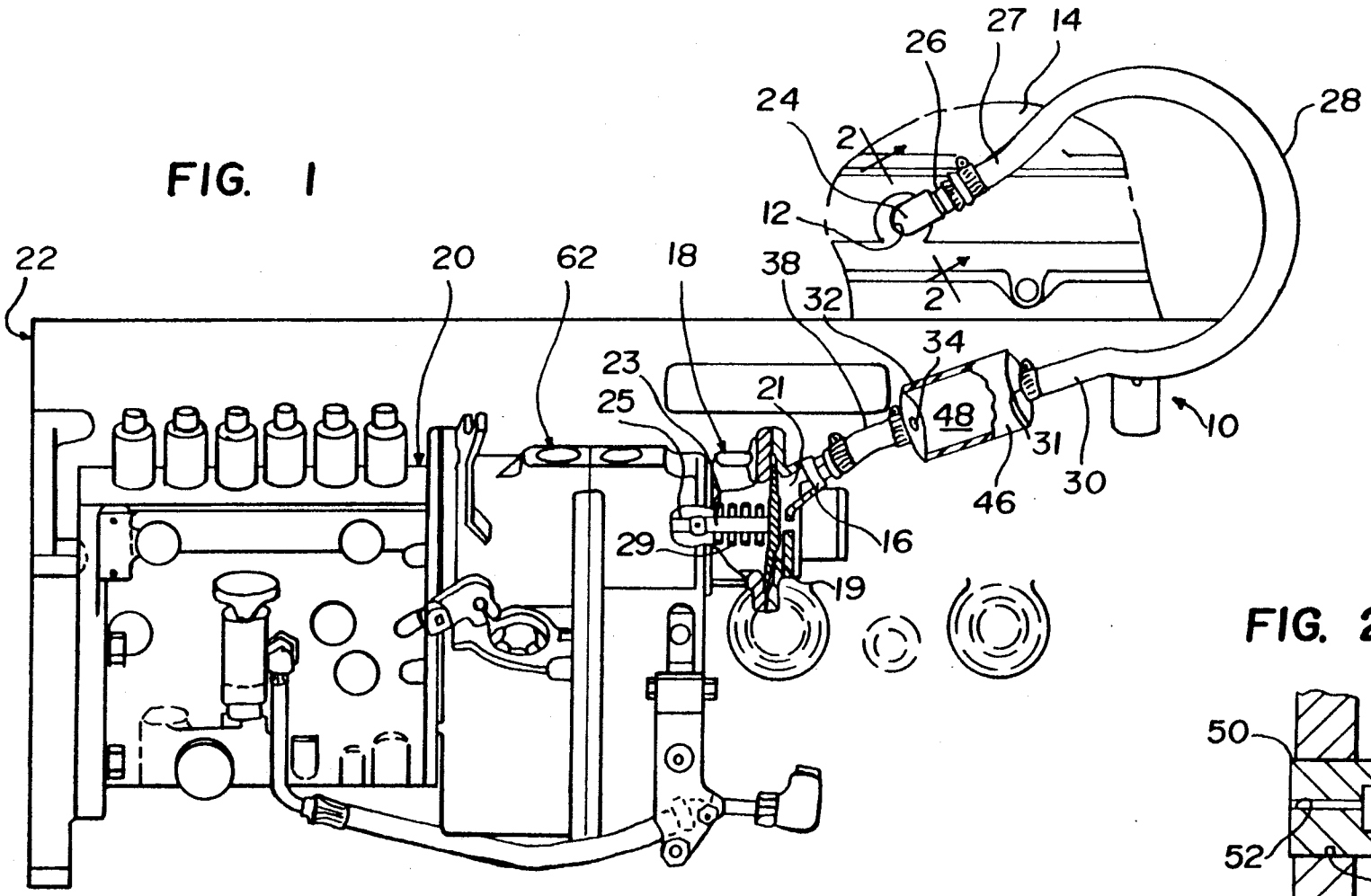
FIG. 1 is a schematic diagram of a selected portions of a diesel engine including an injection pump having an aneroid control and an intake manifold illustrating the aneroid boost modulator of the present invention connected therebetween; and, FIG. 2 is a cross section, taken along the line 2—2 of FIG. 1, through an orifice fitting of the modulator disposed in the intake manifold.

Referring now to the drawings in greater detail, there is illustrated an aneroid boost modulator 10 disposed between a manifold pressure outlet 12 in an intake manifold 14 of a diesel engine 22 and a manifold pressure inlet 16 of an aneroid controller 18 of a fuel injection pump 20 of a diesel engine 22. The aneroid controller 18 is a linear motor of the type in which a diaphragm 19 defines a movable wall of a variable volume chamber 21 within the aneroid controller, the chamber 21 having the manifold pressure inlet 16. The diaphragm 19 controls, through a thrust rod 23 attached thereto and a connecting link 25 to the injection pump governor, the rack position of the injection pump 20 and thus the quantity of fuel delivered to the engine in response to the pressure in the intake manifold 14 during engine acceleration. A return spring 29 maintains the diaphragm in full cutback position until sufficient pressure is present in the variable volume chamber 21 to overcome it. The aneroid controller 18 may be of conventional design such as that illustrated in the aforementioned Brühmann et al. U.S. Pat. No. 4,727,839.

As shown, the modulator 10 includes an orifice outlet fitting 24 seated within the manifold outlet 12 and terminating in a hose fitting 26 which receives one end 27 of a relatively long air hose 28 or other conduit means. The other end 30 of the hose 28 is connected to the inlet 31 of an accumulator 32. The accumulator 32 comprises a housing 46 defining a plenum chamber 48 therewithin. The provision of a specific volume of the plenum chamber 48 is one way in which the action of the aneroid controller 18 may be controlled, as will be described hereinafter.

An outlet 34 of the accumulator 32 is connected by a short hose 38 to the inlet 16 to the variable volume chamber 21 of the aneroid controller 18. Thus, a communication means providing continuous fluid communication is established between the manifold pressure outlet 12 and the variable volume chamber 21 of the aneroid controller 18.

Figure 2:
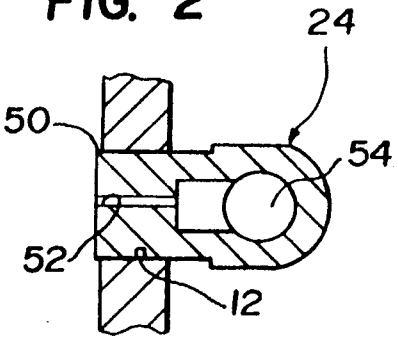

Returning now to the upstream end of the modulator 10, as shown in FIG. 2, an end 50 of the orifice fitting 24 which is engaged within the intake manifold outlet 12 incorporates therein a small orifice 52 which is of a diameter of approximately 0.020" and which has a length of approximately 0.170". The orifice 52 opens into a perpendicular crossbore 54 of significantly increased diameter, as shown, common to hose fittings.

The provision of the orifice 52 substantially restricts the mass air flow from the intake manifold 14 therethrough into the volume formed within the modulator 10, including the hoses 28 and 38 and the accumulator 32, as well as that of the variable volume chamber 21 of the aneroid controller 18. By carefully sizing this volume and the orifice size, a brief time delay can be added to the operation of the aneroid controller 18 during free engine acceleration. Since this delay is only a fraction of a second, such delay becomes insignificant when the engine is operated in normal vehicle operation.

The action of the modulator system 10 will best be understood after a brief synopsis of the means by which the aneroid controller 18 controls delivery of fuel to the injectors of the engine 22, particularly with relation to the provision of air into a turbocharged engine 22.

During engine acceleration, the governor 62 of the engine 22 would normally go to wide open throttle position and deliver the maximum amount of fuel possible to accelerate the engine as fast as possible. However, in turbocharged engines 22, the amount of air provided to the cylinders of the engine 22 depends on the speed of the turbocharger which is in turn dependent upon engine exhaust pressure. Consequently, there is a lag in the provision of adequate air to the engine for complete combustion of all the fuel provided, thus causing black smoke to be emitted from the engine. This smoke is not only a sign of inefficient use of fuel but is visually offensive.

In response to this problem, the aneroid controller 18 has a fuel cut back position, which, in the absence of sufficient pressure in the intake manifold to move the diaphragm 19 against the force of the return spring 29, operates through the thrust rod 23 and governor link 25 to cause the injection pump governor 62 to limit the maximum fuel available during engine acceleration to a level which is substantially cut back or reduced from the wide open throttle fuel quantity normally provided. As the intake manifold pressure increases, indicating that sufficient air is available for complete combustion, the diaphragm moves the thrust rod 23 and governor link 25 to a position permitting governor to provide wide open throttle fuel quantity. Thus, the fuel quantity during engine acceleration can be matched to the available air resulting in a significant reduction in visible smoke.

However, as will be apparent from a perusal of the references cited above, the aneroid controller is designed and various adjustments are made thereto to tailor its operating curve to provide efficient operation of the engine consistent with the practical requirements of the vehicle and the applicable antipollution standards. However, this tailoring may be detrimental to operation under free engine acceleration because such acceleration is of minor importance to vehicle operation and safety.

The modulator 10 of the present invention provides a simple means by which operation of the aneroid controller 18 can be modified during free engine acceleration without adjusting the settings of the aneroid controller 18 itself and without any significant effect on the operation of the engine under loaded conditions, as when accelerating a vehicle.

The specific dimensions set forth herein have been found, through empirical testing, to produce the desired operation of the aneroid controller 18 during free engine acceleration without allowing substantial visible smoke to be emitted from the engine. The hoses 28, 38 have an internal diameter of 5/16 inch and an overall combined length of approximately 15.5 inches. The modulator 10, including the plenum chamber 48 and the hoses 28, 38, has a volume of approximately 5.4 cubic inches, ±10%. The volume of the variable volume chamber 21 within the aneroid controller 18 is small, somewhere in the range of 0.5 cubic inch in the full cutback position, and is thus insignificant in relation to the volume within the modulator 10.

The plenum chamber 48 has been provided to reduce the length of hosing required to create the empirically determined optimum volume for the entire modulator 10 in relation to the dimensions of the orifice 52 of the fitting 24. It will be understood that the volume of the modulator 10 would be increased if the orifice 52 were slightly larger in diameter or significantly shorter than that described herein.

The modulator 10 allows for the use of a low cost mid-range diesel engine in applications where larger displacement diesel engines could not meet stringently controlled smoke production restrictions.

As described above, the modulator 10 has a number of advantages, some of which have been described above and others of which are inherent in the invention. It will be apparent to those of ordinary skill in the art, upon reading the foregoing description that various modifications and alterations may be made to the modulator 10 without departing form the invention embodied therein. For example, although hoses are used in the preferred embodiment to connect the accumulator respectively to the intake manifold and to the aneroid controller, metal tubing of appropriate dimension could also be utilized without affecting the operation of the invention. Accordingly, the scope of the invention should only be limited in accordance with the accompanying claims.

What is claimed is:

1. In combination with an engine having an intake manifold and a fuel injection pump having a rack for controlling fuel output and incorporating an aneroid controller for controlling said rack, said aneroid controller including a variable volume chamber having a full-cutback, unpressurized condition in which said fuel output is limited, an aneroid boost modulator disposed in fluid communication between said intake manifold and said aneroid controller comprising an accumulator, an orifice fitting disposed in said intake manifold and restricting the mass air flow therefrom, and hose means respectively connecting said orifice fitting with said accumulator and said accumulator with said aneroid controller, said accumulator and said hose means having a combined volume several times larger than the volume of said aneroid controller variable volume chamber upon said aneroid controller being unpressurized, said orifice being sized relative to the combined volume of said hose means and said accumulator such that, under free engine acceleration, the operation of said aneroid controller in response to increased pressure in said intake manifold is significantly delayed.

2. The invention in accordance with claim 1 wherein said orifice is approximately 0.020 inch in diameter.

3. The invention in accordance with claim 2 wherein said orifice is approximately 0.170 inch in length.

4. The invention in accordance with claim 1 wherein said predetermined volume is 5.4 cubic inches±10%.

5. In a turbocharged diesel engine having an intake manifold, a fuel injection pump incorporating an aneroid controller, said aneroid controller having a variable volume chamber defined by movable wall means operatively associated with said injection pump to control the operation thereof in response to the pressure in said variable volume chamber, said variable volume chamber having a full cutback position defining a minimum volume thereof, and communication means for fluidly connecting said variable volume chamber to said intake manifold, the improvement wherein said communication means includes an ambient boost modulator for controlling the mass air flow through said communication means during free engine acceleration comprising a restriction element disposed in said communication means, said communication means defining a predetermined volume between said restriction element and said aneroid controller several times larger than said minimum volume of said variable volume chamber.

6. The invention in accordance with claim 5 and said predetermined volume being of a size relative to said restriction element as to cause a significant time delay in the operation of said aneroid controller under free engine acceleration without significantly affecting acceleration of said engine under normal vehicle load.

7. The invention in accordance with claim 5 wherein an accumulator defining a plenum chamber therein is positioned within said predetermined volume of said communication means.

8. The invention in accordance with claim 5 wherein said restriction element comprises a fitting mounted in said intake manifold and having an orifice therein.

* * * * *